United States Patent [19]

Hartmann

[11] 4,434,608

[45] Mar. 6, 1984

[54] METHOD AND AN APPARATUS FOR MANUFACTURING STRANDS FROM WIRES OR ROPES FROM STRANDS

[75] Inventor: Helmut Hartmann, Cologne, Fed. Rep. of Germany

[73] Assignee: Trefilarbed Drahtwerk Köln GmbH, Cologne, Fed. Rep. of Germany

[21] Appl. No.: 339,103

[22] Filed: Jan. 13, 1982

[30] Foreign Application Priority Data

Jan. 15, 1981 [LU] Luxembourg ..... 83064

[51] Int. Cl.[3] ..... D07B 3/10

[52] U.S. Cl. ..... 57/58.52; 57/58.63; 57/58.65; 57/314

[58] Field of Search ..... 57/58.52, 58.63, 58.65, 57/314, 58.54–58.57

[56] References Cited

U.S. PATENT DOCUMENTS

| | | | |
|---|---|---|---|
| 1,907,551 | 5/1933 | Kraft | 57/58.55 |
| 2,572,052 | 10/1951 | Pheazey | 57/314 X |
| 3,362,147 | 1/1968 | Curtis | 57/314 |
| 3,526,570 | 9/1970 | Durkee et al. | 57/314 X |

FOREIGN PATENT DOCUMENTS

| | | |
|---|---|---|
| 601946 | 11/1934 | Fed. Rep. of Germany . |
| 2037607 | 10/1972 | Fed. Rep. of Germany . |
| 365793 | 1/1932 | United Kingdom . |
| 422129 | 1/1934 | United Kingdom . |
| 602307 | 5/1948 | United Kingdom . |
| 1554565 | 10/1979 | United Kingdom . |

*Primary Examiner*—John Petrakes

*Attorney, Agent, or Firm*—Karl F. Ross; Herbert Dubno

[57] ABSTRACT

A method of and an apparatus for the combining of strands comprises swinging a hollow shaft about an axis without rotating this shaft while guiding the strands to an assembly point substantially at the pivot of the shaft. The strands are then spread to pass through a cluster of holes on a distributor plate carried by the shaft before being collected again at a closing point, the points lying substantially along a straight line including an acute angle with the axis about which the cycloidal path is generated.

8 Claims, 1 Drawing Figure

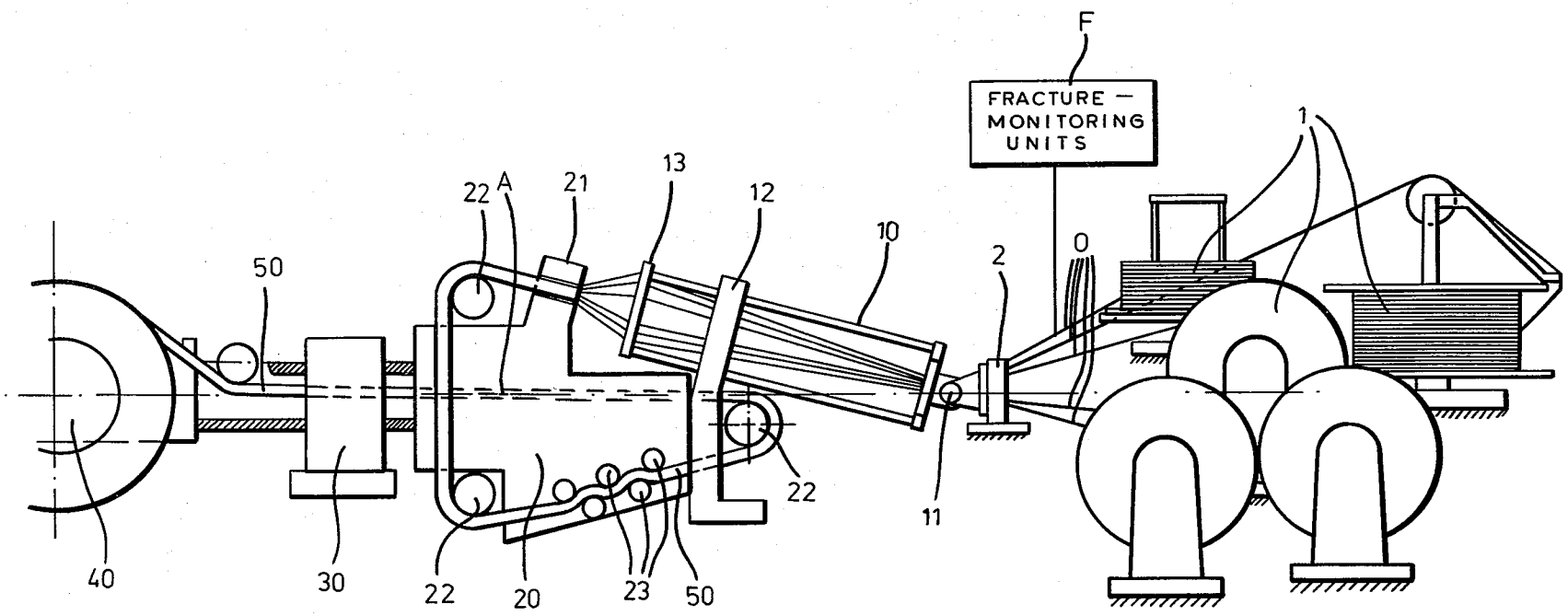
FRACTURE — MONITORING UNITS
F
1
0
2
11
10
12
13
21
A
22
22
22
50
23
20
30
50
40

METHOD AND AN APPARATUS FOR MANUFACTURING STRANDS FROM WIRES OR ROPES FROM STRANDS

FIELD OF THE INVENTION

The present invention relates to a method of manufacturing strands from wires or ropes from strands and to the apparatus required for this.

BACKGROUND OF THE INVENTION

In known stranding or closing machines it is usual for the closing elements to be finished by spools which are separately mounted in a moving or stationary spool support. The closing elements—by which the wires to be stranded and the strands to be closed are particularly meant in this case—must in some cases be put onto the machine spools in a separate working step. Owing to the complicated and continuously repeated replacement of the spools which, as they are mounted in rotating machine parts, can only have a restricted capacity, the running time of the machines is restricted accordingly.

Owing to the arrangement of the spools in the actual machine and the fact that the wires are guided in or around the moving or stationary spool supports, machine length is considerable and large loads have to be moved. The required power is correspondingly high.

OBJECT OF THE INVENTION

The object of the present invention is to provide a novel method for stranding and closing wires and strands by means of which production can be continuous and the running time considerably increased, the rotating mass can be held comparatively small, and the required power comparatively low.

SUMMARY OF THE INVENTION

These objects are attained by the method according to the invention, which is characterised in that, starting from an assembly point lying on an axis of rotation, the wires or strands removed from stationary drawing off units are fanned out to form a cluster, star pattern or array, whose central point lies outside the axis of rotation, from which they are guided to a closing point, the assembly point, the central point and the closing point lying essentially on a straight line extending at an acute angle to the axis of rotation; the array is guided along a cycloidal path and the closing point along an involute path about the axis of rotation.

According to the invention, the finished product thus produced is guided out of the closing point and is deflected at least once and wound up while being rotated about its longitudinal axis. This rotation takes place in synchronism with the closing or stranding rotation, so that the entire system remains in a tension-free state.

As the stranding or closing takes place on account of the relative movement of the wire or strand bundle about an axis of rotation, all the wires or strands describing a cycloidal path in a uniform cluster, there is always a definite, three-dimensional structure at the entrance of the closing point. Experience has shown that the latter feature is one of the conditions which also has to be fulfilled in conventional methods in which the wires to be closed are rotated and the finished product remains stationary. The method according to the invention is therefore also completely different from the attempts, which have hitherto always failed, to carry out the closing operation by simply rotating a closing point.

The main advantage of the method according to the invention is that it enables productivity to be perceptibly increased. It is in fact possible to use drawing off units of any size; the effective production period is only dependent on the capacity of the winding unit.

The apparatus for carrying out the method according to the invention comprises perforated plate arranged downstream of a plurality of stationary drawing off units and serving as an assembly point for the wires or strands a hollow shaft connected at one end to the perforated plate via a cardan joint and at the other end to a driven flyer, which can be rotated about an axis, via a bearing. The flyer comprises a pressing block which serves as the closing point and into which the wires or strands lead in a uniform star pattern via distributor plates mounted at the end of the hollow shaft.

The rotary flyer is caused to rotate by a drive. This is connected to a rotatable winding unit, possibly with the interposition of a withdrawal unit, which is also rotatable; the rotary flyer and the winding unit are therefore rotated in synchronism about the same axis.

The rotary flyer is preferably provided with a plurality of deflector rollers in order to transfer the finished product, which has been withdrawn from the closing point, into the axial direction and to the winding unit.

According to the invention, a straightening unit is also mounted on the rotary flyer to straighten the product.

BRIEF DESCRIPTION OF THE DRAWING

The sole FIGURE (FIG. 1) of the drawing is a schematic illustration of an embodiment of the apparatus, according to the invention, in elevation and partly broken away.

SPECIFIC DESCRIPTION

The wires or strands 0 which are to be processed are drawn off from stationary drawing off units 1 of any type which have a large capacity and are arranged vertically or horizontally and side by side, behind or on top of one another, according to space conditions or forms of delivery.

This consequently also provides the manufacturer of the starting wires with advantages as regards the productivity of his manufacturing apparatus:

As the moving system does not comprise any wind-off spools and there is therefore no need to take into account any space and arrangement conditions in a body of revolution, the wires and strands can be received by any supply units such as windings without spools, wire coils, delivery spools or other known vertical or horizontal, rotary or stationary bearer members and then processed. Furthermore, this arrangement guarantees satisfactory metering of dyes, preservatives and lubricants which are to be applied, which would have to be carried out in a rotating system in conventional methods and is therefore impossible.

The wires or strands 0 are brought together in a perforated plate 2, which serves as an assembly point. In front of this assembly point each individual wire passes through an individual fracture monitoring device F, which turns off the machine when a fracture is detected or the end of the wire is reached.

Starting from the assembly point, the wires or strands 0 are fanned out inside the hollow shaft 10. The latter comprises a distributor plate group 13, in which the elements 0 are arranged to form a certain star array.

A decisive advantage of the apparatus according to the invention lies in the fact that the wires which are to be stranded and the strands which are to be closed are not restricted as regards number and diameter. Corresponding distributor plates and machine tools can be used with little expense. In each case, however, it is the suitability of the starting material and consideration for the influence upon the end product as regards quality which are the limiting parameters of efficiency and not, as was hitherto usually the case, the type of design and construction of the plant.

As can be see, the assembly point and the central point of the distributor plates, as well as the closing point 21, lie along a straight line which extends at an acute angle to the axis A and intersects with the latter in the region of the perforated plate 2 and therefore in the region of the assembly point.

The closing point 21 is rigidly arranged on the rotary flyer 20. When the flyer 20 is rotated about the axis A the closing point 21 follows an involute path. However the distributor plate group 13 describes a cycloidal path, as the hollow shaft 10 is prevented from rotating about its own axis since it is mounted via a cardan joint 11 with a central bore.

The hollow shaft 10 is therefore connected on one hand to the perforated plate via the cardan joint 11 and on the otherhand to the closing point 21 via the wires 0. It is also connected to the flyer 20 via a ball bearing, so that it rotates with the flyer in the form of a cycloid.

The finished rope or the finished strand 50 is guided into a straightening apparatus 23 via deflector rollers 22 and then deflected into the axis of rotation A. This is a space-saving measure and the rope or strand can also be conveyed to the axis of rotation A via the first deflector roller 22 and the straightening apparatus 23, thus using more space.

Further along its course the finished strand or the finished rope 50 is conveyed to a rotating coiler 40 by means of a withdrawal disc which rotates about its own axis and the axis of rotation A of the machine and which is not shown.

Apart from rotating about their own axis, the withdrawal disc and the coiler 40 also rotate about the axis of rotation of the machine. Depending on the arrangement of the winding spool, a rotation solely about the axis of the spool is also sufficient.

I claim:

1. A method of laying up a multiplicity of elongate, flexible elements into a continuous member in a twist formation, comprising the steps of:

(a) feeding said elongate elements from respective supplies thereof at a fixed location to a common assembly point;

(b) passing said elongate elements from said assembly point through respective passages in a cluster array having a center point in an outwardly fanning pattern;

(c) passing said elongate elements from said array to a closing point where said elements are brought together;

(d) rotating said closing point about an axis while swinging said array around said axis without rotating, thereby forming said member, said points lying substantially along a straight line including an acute angle with said axis whereby said array is displaced along a hollow cycloidal path about said axis; and (e) taking up said member.

2. The method defined in claim 1 wherein said member is deflected at least once between said closing point and being taken up, the take-up of said member being synchronized with the rotation of said closing point about said axis.

3. The method defined in claim 1 or claim 2, further comprising the step of straightening said member between the closing point and the take-up of said member.

4. An apparatus for laying up a multiplicity of elongate flexible elements into an elongated member having a twist configuration, comprising:

(a) a plurality of supply reels disposed at fixed locations and carrying respective elongate elements;

(b) an assembly point formed with a perforated plate traversed by said elements;

(c) a hollow shaft connected at one end to said assembly point and formed at an opposite end with a distributor plate having a cluster array of passages traversed by said elements whereby said elements fan out to said distributor plate from said assembly point, said hollow shaft being connected to said assembly by a hollow universal joint traversed by said elements and enabling said shaft to swing while preventing rotation of said shaft, said array having a center point;

(d) a flyer rotatable about an axis and formed with an eye receiving said elements from said distributor plate, said eye being spaced outwardly from said axis and disposed along a line connecting said center point and said assembly point and including an acute angle with said axis whereby said elements are laid up in said eye to form said member in a twist pattern; and (e) means rotatable with said flyer for taking up said member.

5. The apparatus defined in claim 4 wherein said means for taking up said member and said flyer having synchronously coupled drives.

6. The apparatus defined in claim 4, further comprising deflector rollers on said flyer for deflecting said member between said eye and said taking-up means.

7. The apparatus defined in claim 4, further comprising a straightening unit on said flyer for straightening said member between said eye and said taking-up means.

8. The apparatus defined in claim 4, further comprising fracture-monitoring means between said reels and said assembly point.

* * * * *